US010501894B2

(12) United States Patent
Naumov et al.

(10) Patent No.: US 10,501,894 B2
(45) Date of Patent: Dec. 10, 2019

(54) RAIL FASTENING

(71) Applicant: Boris Vladimilenovich Naumov, Moscow (RU)

(72) Inventors: Boris Vladimilenovich Naumov, Moscow (RU); Aleksandr Alekseevich Bobryshev, Stary Oksol Belgorodskaya obl. (RU); Leonid Valentinovich Groshev, Dolgoprudny Moskovskaya obl. (RU); Vladimir Igorievich Eramov, Moscow (RU); Sergei Jurievich Lubotsky, Moscow (RU)

( * ) Notice: Subject to any disclaimer, the term of this patent is extended or adjusted under 35 U.S.C. 154(b) by 300 days.

(21) Appl. No.: 15/523,245

(22) PCT Filed: Nov. 30, 2015

(86) PCT No.: PCT/RU2015/000832
§ 371 (c)(1),
(2) Date: Apr. 28, 2017

(87) PCT Pub. No.: WO2016/108728
PCT Pub. Date: Jul. 7, 2016

(65) Prior Publication Data

US 2017/0350077 A1 Dec. 7, 2017

(30) Foreign Application Priority Data

Dec. 30, 2014 (RU) ..... 2014154012

(51) Int. Cl.
*E01B 9/42* (2006.01)
*E01B 9/38* (2006.01)
(Continued)

(52) U.S. Cl.
CPC ..... *E01B 9/42* (2013.01); *E01B 9/38* (2013.01); *E01B 9/483* (2013.01); *E01B 9/68* (2013.01); *E01B 2201/00* (2013.01)

(58) Field of Classification Search
CPC ..... E01B 9/38; E01B 9/40; E01B 9/42; E01B 9/483; E01B 9/46; E01B 9/68
See application file for complete search history.

(56) References Cited

U.S. PATENT DOCUMENTS 2,954,169 A * 9/1960 Rigby ..... E01B 9/486 238/349
4,511,081 A * 4/1985 Wilson ..... E01B 3/16 238/321
(Continued)

FOREIGN PATENT DOCUMENTS

RU 61147 A1 11/1941
RU 124689 U1 2/2013
(Continued)

OTHER PUBLICATIONS

International Search Report PCT/RU2015/000832 dated Feb. 18, 2016.

*Primary Examiner* — Jason C Smith
(74) *Attorney, Agent, or Firm* — Roberts Mlotkowski Safran Cole & Calderon P.C.

(57) ABSTRACT

A rail fastener comprises a rail support in a form of a bracket secured to a rail base and an lever oriented in perpendicular to the rail longitudinal axis, wherein one end of the lever is articulated to the bracket by a silentblock and the other end comprises a rail mounting platform equipped with limiters of the rail displacement in the direction perpendicular to the rail track axis. The rail is secured to the rail support by two clips disposed astride the rail. Some ends of the clips are taken under the lower surface of the rail platform, while the other ends abut on the upper surface of the rail flange via hexagonal adjusters each having an orifice located eccentrically in relation to the hexagon axis and receiving the other end of the clip. The rail fastener further comprises two elastic members disposed between the rail and the rail base
(Continued)

astride the lever, and their thickness is selected so as to form a gap between the rail base and the lower surface of the lever in a position when the rail receives a load of a train wheels.

9 Claims, 3 Drawing Sheets

(51) Int. Cl.
*E01B 9/48* (2006.01)
*E01B 9/68* (2006.01)

(56) References Cited

U.S. PATENT DOCUMENTS

| | | | | | |
|---|---|---|---|---|---|
| 5,735,458 | A * | 4/1998 | Brown | E01B 9/303 | |
| | | | | 238/343 | |
| 9,315,947 | B2 * | 4/2016 | Cox | E01B 9/30 | |
| 2017/0350077 | A1 * | 12/2017 | Naumov | E01B 9/38 | |
| 2018/0023256 | A1 * | 1/2018 | Constantine | E01B 9/42 | |
| | | | | 238/290 | |
| 2018/0363250 | A1 * | 12/2018 | Constantine | E01B 9/62 | |

FOREIGN PATENT DOCUMENTS

| | | | |
|---|---|---|---|
| SU | 1633051 | A1 | 3/1991 |
| WO | 2014140530 | A1 | 9/2014 |

* cited by examiner

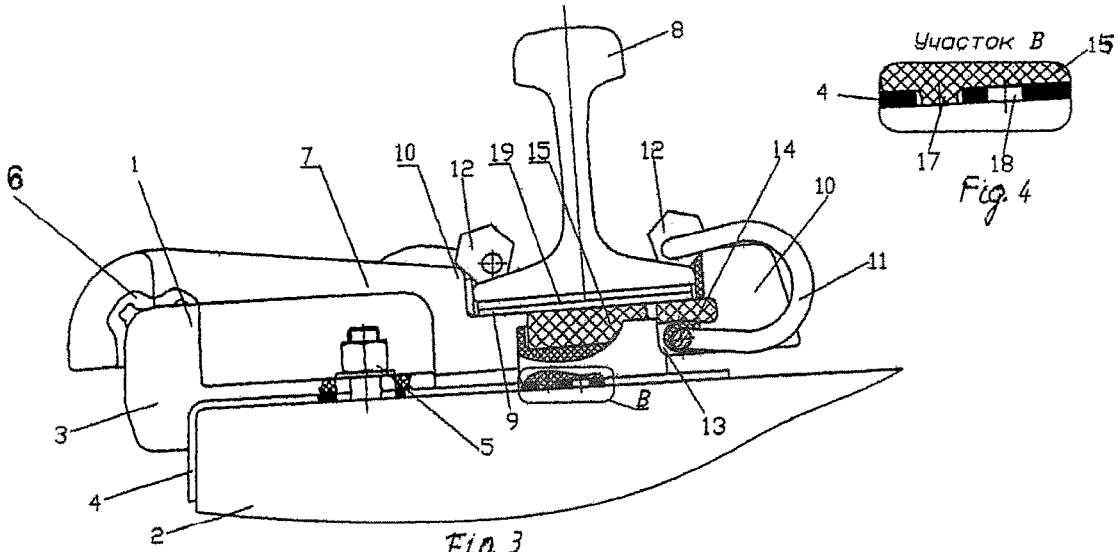
Fig. 4
Fig. 3
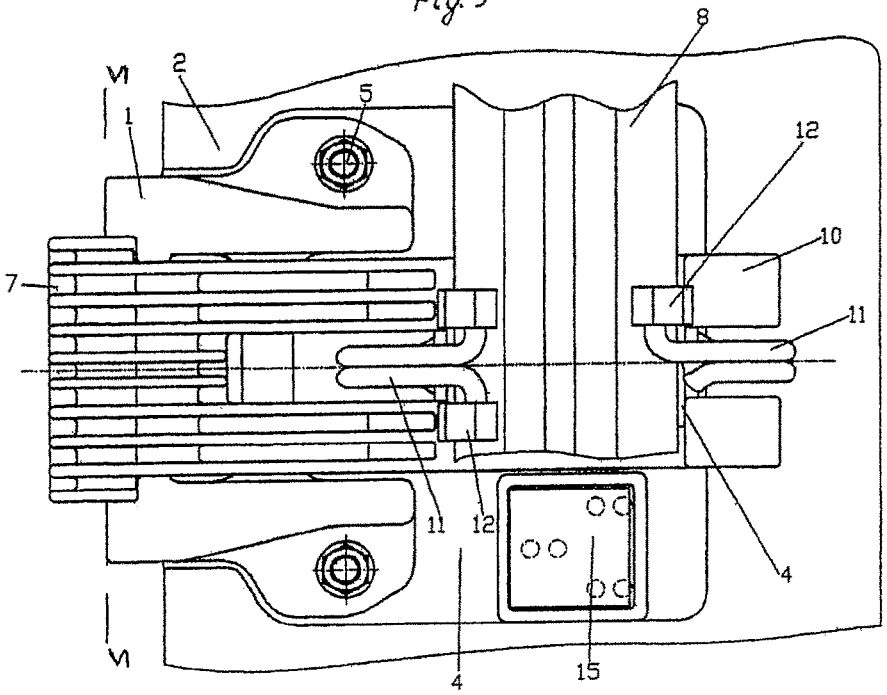
Fig. 5

RAIL FASTENING

BACKGROUND OF THE INVENTION

Field of the Invention

The invention relates to the field of railway equipment, namely to devices for fastening rails to rail seats, and more particularly it relates to rail fasteners.

The invention may be used in track facilities, including underground railways.

Description of Related Art

Known rail fastener arrangements may be classified into two general groups, inseparable rail fasteners and separable rail fasteners. Inseparable fasteners are characterized in that the rail and the rail support are fastened to the rail seat by the same fastening member, whereas in separable fasteners, the rail and the rail support are secured by separate fastening members; the rail support is fastened to the rail seat by anchor bolts, screws, insert bolts, etc., and the rail is fastened to the rail support by other fastening members like bolts, clips, and braces. The main disadvantage of the inseparable rail fasteners is concentration of high load in the fastener unit during its operation, which causes mechanical damage of the fastening members (anchors, screws, etc.) and the rail seat.

Separable rail fasteners are advantageous over inseparable rail fasteners in that they are simpler in operation as they allow replacing rails with no removing the rail support and dismounting the members fastening the rail support to the track, thus assisting in increase of durability of the fastening members as well as the rail seat. The fastener units attaching the rail support to the rail seat in separable rail fasteners operate in considerably more favorable conditions, as the tension and torsion loads are distributed over other fastener components.

Moreover, separable rail fasteners allow using threadless rail fastening systems. Their main advantage is sharp decrease in track maintenance cost owing to excluding threaded joint tightening work.

In separable rail fasteners, the rail is braced directly to the rail support and the tension force is concentrated exactly in the rail support. This is not a critical factor when the rail support is made of a metal, as metals work good enough under tension.

Using polymeric materials for manufacturing the rail support in separable rail fasteners is problematic, as up-to-date high-strength plastics are not able to carry a tension load in the place of contact between the support and the rail fastening means causing the tension force.

This point prohibits providing plastic separable rail fasteners, despite of their numerous advantages. In particular, using up-to-date high-strength plastics in the fasteners would allow decreasing the fastener weight and assuring high precision of maintaining the rail support characteristics, as well as it would facilitate excluding additional longitudinal and sectional track adjustments during construction works and fastener repair works.

There is a known separable rail fastener of WO2014140530 (A1), 2014 Sep. 18, disclosing a solution for providing a rail support made of a plastic. This rail fastener comprises a rail support in a form of an elongated member made of a plastic and configured to bear a rail, and two metal brackets symmetrically disposed under the elongated plastic member and attached thereto by projections (two projections in each bracket) protruded through four slots provided the plastic member, wherein the form and dimensions of the projections correspond to the slots. The end portions of the elongated member comprise openings for bolts attaching the rail support to the track base. A rail-receiving recessed area is provided in the support, and an elastic under-rail member, which is an elastic insert, is provided under the rail flange. A means for fastening the rail to the rail support is provided in a form of two resilient clips disposed astride the rail and mounted so as one end of each clip is pressed to the upper rail flange surface and the other end of each clip comprises two legs receivable in sockets provided in corresponding projections of the metal brackets.

The metal brackets of this rail fastener allow relieving stress is the elongated plastic member and transferring the pressing force to the rail receiving area, thus avoiding tension forces in the plastic member. In the known arrangement of WO2014140530, the tension forces are substantially isolated in the two metal brackets; moreover high bending forces are generated therein as well, so these parts shall be made of metal and shall be provided in a form of complex-shaped brackets, which complicates manufacturing technology of such an arrangement. Additionally, this solution implies high material consumption of the arrangement and increased weight of the whole rail fastener. Moreover, the surface of contact between metal and plastic materials in the area where the brackets engage the support is a weak link, since it does not contain any shock absorbers, so the plastic tends to be excessively worn in these regions. Mounting this kind of rail fasteners is complicated, as both clips have to be simultaneously tension-mounted while fastening the rail to the rail support.

BRIEF SUMMARY OF THE INVENTION

The problem of the present invention is providing an arrangement of a separate rail fastener, wherein tension and bend forces are eliminated in a rail support, providing possibility of manufacturing a plastic rail support with no complex-shaped metal parts therein, assuring high reliability and durability of the rail fastener under operational load and providing decrease in weight of the rail fastener, as well as simplification of manufacturing and maintenance thereof.

The advantageous effect attainable by the claimed rail fastener is providing a structurally simple and operationally convenient way of assuring durability and reliability of the rail track under high dynamic loads caused by movement of rolling stock, and providing cost-effective manufacturing the rail fasteners using up-to-date polymeric materials.

This problem is met by a rail fastener comprising a rail support having means for fastening to the track base, and configured to receive a rail and fasten the rail to the rail support by at least one resilient clip located aside the rail; and at least one under-rail elastic member. The rail support is provided in a form of a bracket comprising means for rigid fastening to the track base and an lever disposed in perpendicular to the rail longitudinal axis, wherein one end of the lever is articulated to the bracket and the other end comprises a rail installation platform equipped with limiters of the rail displacement in the direction perpendicular to the track axis. The resilient clip is configured so its first end is to be taken under the lower surface of the rail installation platform, and its second end abuts on the outer surface of the rail flange. The at least one under-rail elastic member is disposed between the rail and the track base aside the lever in the direction of rail axis, and its thickness is selected so as to form a gap between the track base and the lower surface of the lever in a loaded position when the rail receives a load of train wheels.

It is expedient to equip the arrangement with two resilient clips disposed astride the platform, so each clip engages corresponding side of the rail flange, and further with two under-rail elastic members disposed astride the lever in the direction of the rail axis.

It is desirable to provide the articulated connection between the lever and the bracket by a silentblock, in order to decrease the hinge friction.

It is also desirable to provide means for clamping the ends of the resilient clips on the lower surface of the platform bearing the rail, in order to assure increased operational reliability of the fastener.

It is possible to provide the upper ends of the resilient clips so as each of them is to be received in an axial orifice of a corresponding hexagonal adjuster, which adjuster abuts on the upper surface of the rail flange with its one face, and the axial orifice is located eccentrically in relation to the hexagon axis, in order to assure possibility of the rail height position adjustment.

In a preferable embodiment, a protective pad is disposed between the track base and the bracket, and the protective pad surface has protrusions/recesses located according to disposition of the elastic members and configured to engage the counterpart protrusions/recesses located on the lower surfaces of the elastic members, so as to affix the elastic members coaxially with the rail in a predetermined distance from the hinge.

It is desirable to configure the protrusions/recesses of the protective pad so as to provide the possibility of adjustment of the distance between the elastic member and the hinge.

In the claimed arrangement, it is possible to provide made of a non-elastic material having a high friction factor in relation an under-rail insert to the rail material.

The invention is further explained by description of preferable embodiments with reference to the attached drawings.

BRIEF DESCRIPTION OF THE DRAWINGS

FIG. 3 shows a partial cross-section view of the rail fastener, when the rail is fastened to the rail base;

FIG. 4 shows enlarged portion B of FIG. 3;

FIG. 5 shows a plan view of the rail fastener of FIG. 3;

DETAILED DESCRIPTION OF THE INVENTION

Figures 1, 2:
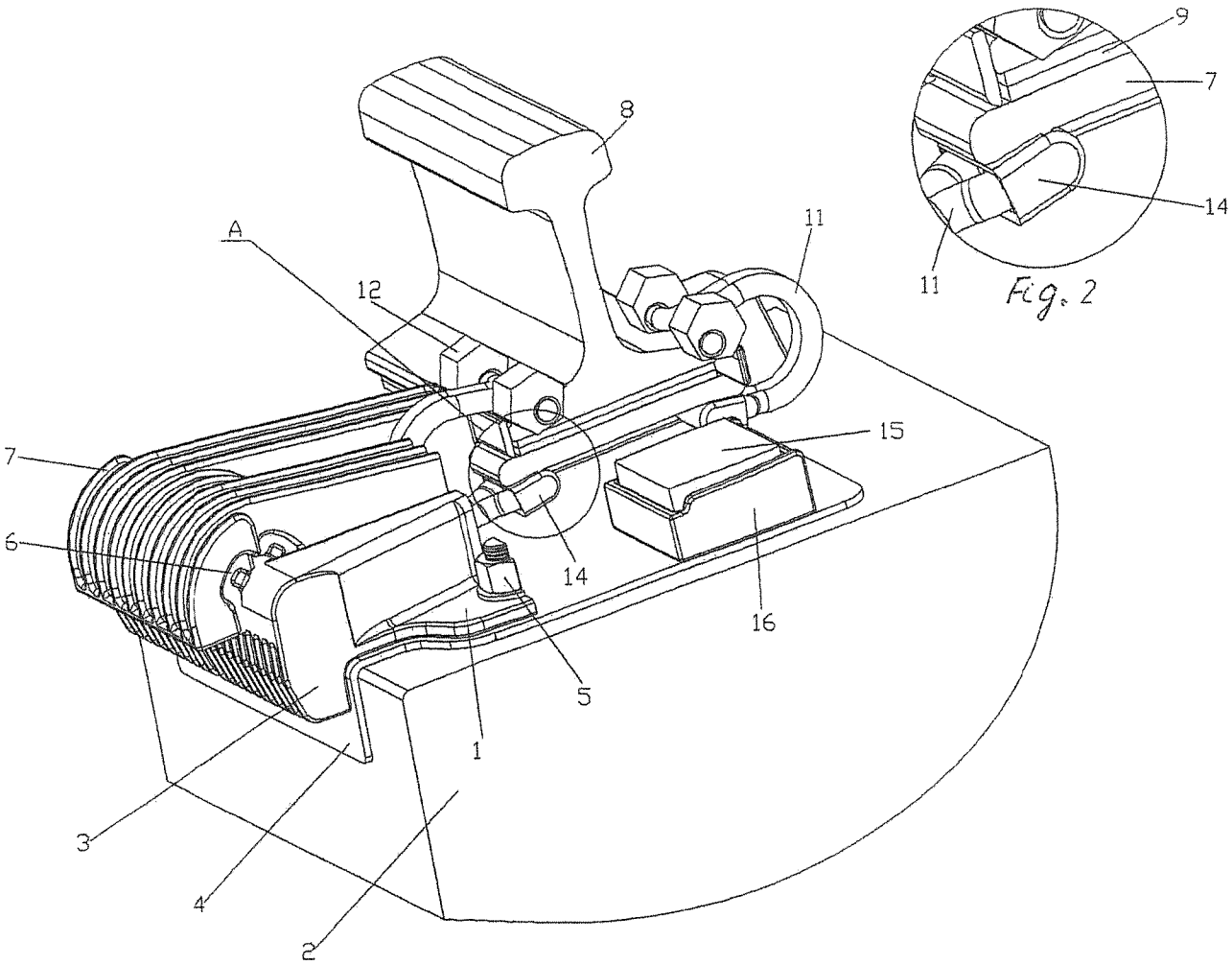
FIG. 1 shows a 3D view of a rail fastener according to the invention.
FIG. 2 shows enlarged portion A of FIG. 1.
Figure 6:
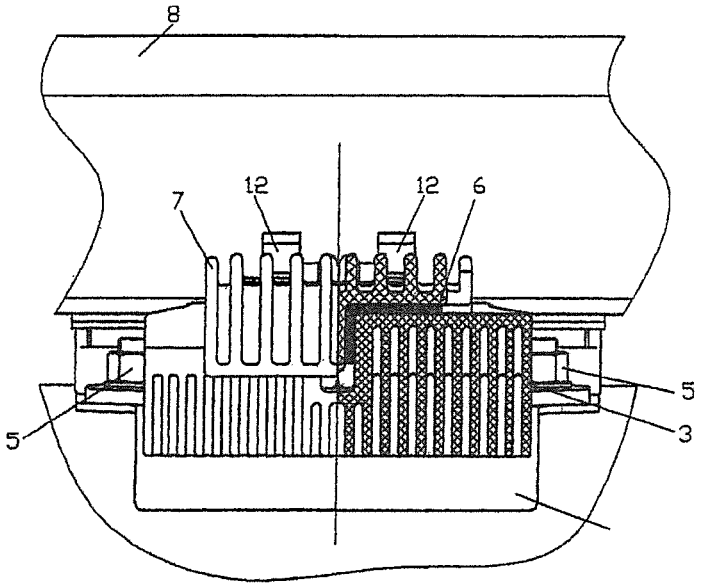
FIG. 6 shows a partial VI-VI cross-section view of the rail fastener of FIG. 5.

A rail fastener shown in FIGS. 1, 2, 3, 4, 5, 6, 7 comprises a bracket 1, which lower surface is positioned adjacent to a rail base 2, and which has an end portion 3 orthogonally bent downwards and positioned adjacent to the side surface of the rail base 2. A protective pad 4 made of an elastomer (e.g. rubber or polyurethane) is positioned between the bracket 1 and the rail base 2 in order to avoid their mutual abrasion during operation. The bracket 1 is secured to the rail base 2 by two bolts 5. A lever 7 directed in perpendicular to the longitudinal axis of the rail 8 is connected to the bracket 1 by a silentblock 6, the lever 7 supporting the rail 8. A platform 9 for installation of the rail 8 is provided on the opposite end of the lever 7, which platform is fenced about by projections 10 configured to limit displacement of the rail 8 in the direction perpendicular to the axis of the rail track. The silentblock 6 (FIG. 6) serves as an articulated joint between the lever 7 and the bracket 1 and is a polyurethane member formed by pouring a polyurethane mixture into a gap between the lever 7 and the bracket 1 during the fastener mounting process. The bracket 1 and the lever 7 secured thereto by the articulated joint together form a rail support. The described arrangement and manufacturing technology allow compensating inaccuracy in dimensions of the lever 7 and the bracket 1 by adjusting their positions while pouring the polyurethane composition during assembling, and thus assuring necessary coupling dimensions of the fastener. The silentblock 6 eliminates friction in the articulated joint and abrasion wear of the contacting parts. To-and-fro movements of the lever 7 are provided owing to elastic deformation of polyurethane, which the silentblock 6 is made of. Using the articulated joint between the lever 7 and the bracket 1 allows eliminating application of pulling forces to the bolts 5, which secure the rail support to the rail base 2.

Figure 7:
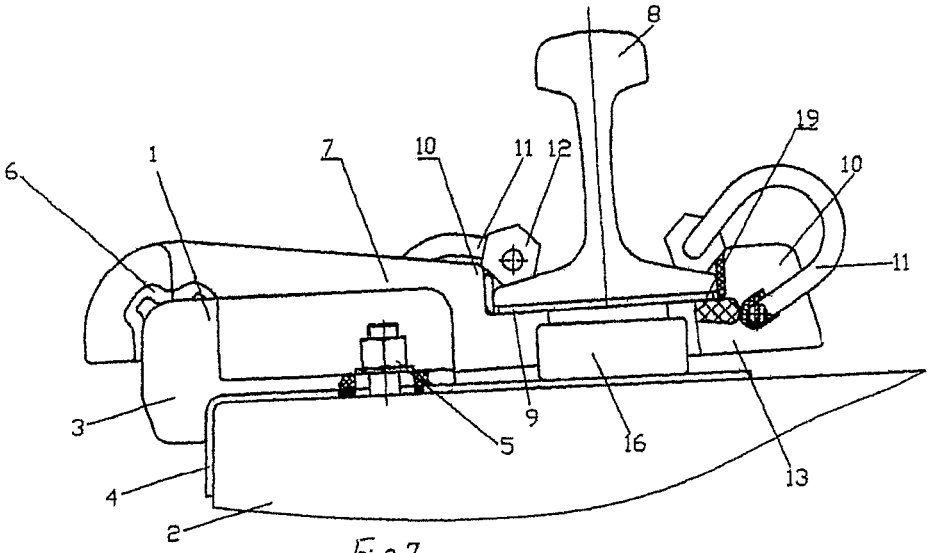
FIG. 7 shows a partial cross-section view of the rail fastener of FIG. 3, when the rail is in the position before fastening.

Additionally, the rail fastener comprises at least one, in this particular case two resilient clips 11 (FIGS. 1, 3 and 5). The clips 11 are intended to secure the rail 8 to the platform 9 of the lever 7 and configured as resilient torsion or bending springs, which press the rail flange to the lever 7 (i.e. to the rail support). The clips 11 are disposed astride the platform 9 bearing the rail 8. Each clip 11 engages the corresponding side of the rail flange. The upper ends of the clips 11 are disposed over the rail flange and abut on the outer surface of the rail flange. In the disclosed embodiment, the upper end of each clip 11 has two legs bent in the opposite directions, each leg configured to be inserted into an axis orifice of a polygonal, in this particular case hexagonal adjuster 12, which adjuster abuts on the upper surface of the rail flange with its one face. The axial orifice is located eccentrically in relation to the central axis of the adjuster 12, so the height position of the rail 8 may be adjusted by rotating the adjuster 12 about its central axis. The more thickness of the body of the adjuster 12 is provided between the clip 11 and the rail 8, the lover the rail 8 is positioned and vice versa. This adjustment is performed by adding or removing under-rail inserts 19 along with rotation of the adjuster 12. The lower ends of the clips 11 are taken under the lower surface of the lever 7 in the area of the platform 9 in order to secure the rail 8. Means for clamping the clip ends (like grooves 13 in FIG. 7) corresponding to the shape of the clip ends are provided on the lower surface of the platform bearing the rail, which allows assuring increased operational reliability of the fastener under load. Moreover, the clip ends are equipped with protective caps 14 (FIG. 2) made of an elastomer, which allows preventing abrasion wear of the clip 11 and the lever 7 during their interaction and additionally increases reliability of the fastener. In FIG. 7, the rail fastener according to the invention is shown in the initial position prior to clamping the lower ends of the clips 11. In FIG. 3, the same fastener is shown in the operational position, where the rail 8 is pressed against the lever 7 by the clips 11.

The lower ends of the clips 11 are taken under the rail flange, thus avoiding effect of tension forces or combined tension/bend forces generated in the lever material, so requirements regarding the lever material may be lower; in particular, the lever 7 in the claimed arrangement may be made of materials like various filled polyamides. This solution provides the component with high precision of predetermined parameters and at the same time keeps its cost lower than a similar metal component cost, as well as allows avoiding corrosion relevant to metal parts.

Installation of this rail fastener does not require both clips to be simultaneously tension-mounted. This arrangement allows mounting the clips sequentially, which makes the fastener installation easy and simple.

The rail fastener also comprises at least one, in this particular case two under-rail elastic members 15 disposed astride the lever 7 between the rail 8 and the rail base 2 and oriented in the direction of longitudinal axis of the rail 8. Thickness of the under-rail elastic member 15 is selected so as to form a gap between the surface of the rail base 2 and the lower surface of the lever 7 in a position when the rail 8 receives a load from wheels during movement of rolling stock. Thickness of the under-rail elastic member 15 is also selected based on the track rigidity requirement. The under-rail elastic member 15 may be a monolithic part or it may be an assembly. It may be arranged as an elastic member made of an elastomer like solid polyurethane or foamed polyurethane, as well as it may be made of a metal. For instance, the under-rail elastic member 15 may be provided in a form of a foamed polyurethane pillow inserted into a cup 16 as shown in FIG. 1. The outer bottom surface of the cup 16 or alternatively the lower surface of the under-rail elastic member 15 itself may comprise docking protrusions or recesses configured to engage the counterpart protrusions or recesses of the protective pad 4 disposed directly on the rail base 2. FIG. 4 shows an example of the under-rail elastic member 15 having a protrusion 17 received in a recess 18 of the protective pad 4. The under-rail elastic member 15 takes a predetermined position when the docking protrusion 17 engages the recess 18.

The protective pad 4 may comprise a few recesses 18 disposed at some distance from each other in the direction perpendicular the track axis. By inserting the docking protrusion 17 into one or another recess 18, it is possible to install the elastic members 15 in different positions, thus providing their displacement in the direction perpendicular the track axis and modifying the distance between the axis of the articulated joint of the lever 7 and the elastic member 15. The rail 8 is positioned on the lever 7 and it rotates about the axis of the articulated joint together with the lever 7, so the lever 7 is exposed to two forces, one of them is caused by train wheels and applied to the rail 8 in the top-down direction. This force has a constant moment arm (defined by the distance to the articulated joint) and provides a corresponding constant torque moment, which tends to turn the lever 7 downwards. The other force is applied to the rail 8 in the down-top direction and is caused by reaction of the elastic member 15, which rests on the track base. The elastic member 15 may be disposed at different distance from the axis of the articulated joint, so the moment of force applied to the rail from below depends on the position of the elastic member 15, therefore the track rigidity depends on that distance. Thus, the claimed arrangement of the rail fastener allows modifying the rail track rigidity with no replacement of the elastic member 15.

The claimed rail fastener is characterized by that the under-rail elastic members 15 locate between the rail 8 and the rail base 2, i.e. the rail 8 abuts on the under-rail elastic members 15 mounted upon the rail base 2, so the rail load caused by movement of rolling stock is transferred directly to the rail base 2, while the rail support is not exposed to a vertical force. This allows reducing dimensions of the rail support, increasing its durability and using less expensive materials (including plastics) for manufacturing thereof.

An under-rail insert 19 is located on the platform 9 of the lever 7, intended for disposition of the rail 8, which insert is a plate having side protrusions engaging butt ends of the projections 10 and limiting displacement of the plate along the axis of the rail 8. In this arrangement, damping of the rail fastener is provided by the elastic members 15 disposed astride the rail support, so the under-rail insert 19 is made of a hard, non-elastic material. The main purpose of the under-rail insert 19 is providing a friction force between the rail flange and the lever 7, which force is necessary for preventing creep of rail, i.e. displacement of the rail along the track axis. Therefore, the under-rail insert 19 is made of a hard plastic material characterized by a high friction factor in respect of the rail material.

In all known arrangements of rail fasteners, the main function of such an insert is providing elasticity of the fastening unit; this is why it is usually implemented so as to be elastic enough. However, such an elastic insert deteriorates operation of the clips; the clamping force and the resilient stroke of the clips are partially consumed by the insert deformation, moreover, the insert is additionally compressed when each wheel of the rolling stock passes by, which causes the clip operating under cyclic load. Besides providing elasticity of the fastening unit, the insert has to assure a friction force necessary for preventing creep of rail, i.e. displacement of the rail along the track axis. If the insert is compressed under its operational loads, the clamping force and the resilient stroke of the clips have to be increased in order to assure necessary friction even when the insert is compressed by 1 or 2 mm. In the claimed rail fastener, this part is intended solely to provide maximal friction; this allows decreasing a tightening force between the clip and the rail support. Therefore, in the claimed arrangement of the rail fastener the clips operate under substantially reduced load, so their life time is extended and their maintenance is simplified.

The rail fastener according to the claimed invention operates as follows.

When rolling stock moves, the rail 8 is exposed to loads causing downward displacement of the rail according to the path defined by the lever 7, which pivots at the silentblock 6. The silentblock 6 eliminates friction and abrasion wear even at a considerable (5 to 8 mm) displacement of the rail 8, and additionally assures necessary rigidity of the rail fastener in horizontal directions along and across the rail axis. The clips 11 press the rail 8 against the lever 7 and provide movement of the rail 8 together with the lever 7; additionally, they assure a friction force necessary for retaining the rail 8 in the direction of the track axis. The elastic members 15 take the vertical load of the rolling stock and transfer it to the rail base 2 in a resilient manner, thus facilitating suppression of occurring vibrations. Therefore, the fastening members of the rail support, the bolts 5 are free from pulling forces, so they are able to reliably secure the claimed rail fastener to the rail base 2.

The claimed rail fastener is highly reliable, as its arrangement prevents rupture and pull-out of the fastening members under occurring loads, as the lever 7 is attached to the base 2 by the silentblock 6. When a back wave of the load caused by rolling stock occurs, the rail 8 goes up and just slightly turns the lever 7 in the silentblock 6 by a tiny angle. The clip 11, which secures the rail 8 to the rail support during installation of the fastener, is configured to be taken under the rail, so the material of the lever 7 is free from tension stress or combined tension/bend stress and plastics or other materials having tensile strength lower than that of steel and cast iron may be used for manufacturing the rail fasteners. Moreover, the claimed rail fastener does not contain any metal-consuming elements requiring complicated technology, which facilitates decreasing the production cost of the rail fastener. The claimed arrangement provides easier and simpler installation and maintenance of the rail fastener.

The invention claimed is:

1. A rail fastener comprising:

a rail support configured to bear a rail;

means for fastening the rail support to a rail base;

at least one clip having a first end and a second end, located aside the rail and configured to secure the rail to the rail support;

at least one under-rail elastic member disposed between the rail and the rail base, wherein the rail support is provided in a form of a bracket comprising means for rigid fastening the bracket to the rail base and a lever having a first end and a second end, the lever disposed in perpendicular to the rail longitudinal axis, wherein the first end of the lever is hingedly connected to the bracket and the second end of the lever comprises a platform having an upper surface and a lower surface, wherein the upper surface is intended for clampingly installing the rail thereon and equipped with limiters of displacement of the installed rail in the direction perpendicular to the track axis, wherein the at least one clip is configured so the first end thereof is to be taken under the lower surface of the rail installation platform, and the second end thereof abuts on the upper surface of the rail flange; the at least one under-rail elastic member has a predetermined thickness and is disposed between the rail and the rail base aside the lever in the direction of the rail axis and the predetermined thickness is selected so as to form a gap between the rail base and the lower surface of the lever, facing the rail base, in a position when the rail secured to the platform receives a load from wheels of a passing train.

2. The rail fastener of claim 1, wherein two of the clips are disposed astride the platform and configured so the second end of each clip engages corresponding side of the rail flange, and two of the under-rail elastic members are disposed astride the lever in the direction of the rail axis.

3. The rail fastener of claim 2, wherein the lever is connected to the bracket by a silentblock.

4. The rail fastener of claim 2, wherein means for clamping the first ends of the clips are provided on the lower surface of the platform.

5. The rail fastener of claim 2, wherein hexagonal adjusters, which quantity corresponds to the quantity of the clips, wherein each hexagonal adjuster abuts on the upper surface of the rail flange with its one face, and has an axial orifice located eccentrically in relation to the hexagon axis, the axial orifice receiving the second end of the corresponding clip made of a resilient material.

6. The rail fastener of claim 2, wherein the protective pad is located between the rail base and the bracket, wherein the protective pad surface comprises salient members located according to disposition of the elastic members and configured to engage counterpart salient members located on the lower surfaces of the elastic members, and to affix the elastic members coaxially with the rail in a predetermined distance from the silentblock.

7. The rail fastener of claim 6, wherein the salient members of the protective pad are configured to provide adjustment of a distance between the elastic member and the silentblock.

8. The rail fastener of claim 6, wherein an under-rail insert is disposed between the rail and the platform, and the under-rail insert made of a non-elastic material having a high friction factor in relation to the rail material.

9. The rail fastener of claim 7, wherein an under-rail insert is disposed between the rail and the platform, and the under-rail insert is made of a non-elastic material having a high friction factor in relation to the rail material.

* * * * *